US011852386B2

(12) United States Patent
Kanatani et al.

(10) Patent No.: US 11,852,386 B2
(45) Date of Patent: Dec. 26, 2023

(54) HEAT EXCHANGER AND REFRIGERATION CYCLE APPARATUS

(71) Applicant: Mitsubishi Electric Corporation, Tokyo (JP)

(72) Inventors: Toshiki Kanatani, Tokyo (JP); Hiroki Ishiyama, Tokyo (JP); Yusuke Tashiro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 357 days.

(21) Appl. No.: 17/280,560

(22) PCT Filed: Nov. 22, 2018

(86) PCT No.: PCT/JP2018/043145
§ 371 (c)(1),
(2) Date: Mar. 26, 2021

(87) PCT Pub. No.: WO2020/105164
PCT Pub. Date: May 28, 2020

(65) Prior Publication Data

US 2022/0042724 A1 Feb. 10, 2022

(51) Int. Cl.
*F25B 13/00* (2006.01)
*F25B 39/02* (2006.01)
(Continued)

(52) U.S. Cl.
CPC ..... *F25B 13/00* (2013.01); *F25B 39/02* (2013.01); *F25B 39/04* (2013.01); *F28F 1/40* (2013.01);
(Continued)

(58) Field of Classification Search
CPC ..... F25B 13/00; F25B 39/02; F25B 39/04; F25B 2500/01; F28F 1/40; F28F 13/187; F28F 2210/08
See application file for complete search history.

(56) References Cited

U.S. PATENT DOCUMENTS

2017/0328614 A1* 11/2017 Yokozeki ..... F25B 13/00
2017/0355921 A1* 12/2017 Matsumoto ..... C10M 171/008

FOREIGN PATENT DOCUMENTS

CN 1412516 A * 4/2003 ..... F28D 1/0408
CN 1412516 A 4/2003
(Continued)

OTHER PUBLICATIONS

Pdf is translation of foreign reference CN-1412516-A (Year: 2003).*
(Continued)

*Primary Examiner* — Henry T Crenshaw
*Assistant Examiner* — Kamran Tavakoldavani
(74) *Attorney, Agent, or Firm* — POSZ LAW GROUP, PLC

(57) ABSTRACT

A heat exchanger includes a heat transfer tube. The heat transfer tube includes a first tube portion, and second tube portions connected in parallel with each other with respect to the first tube portion. The first tube portion has a first inner circumferential surface, and first grooves recessed relative to the first inner circumferential surface and arranged side by side in a circumferential direction of the heat transfer tube. The second tube portions each have a second inner circumferential surface, and a plurality of second grooves recessed relative to the second inner circumferential surface and arranged side by side in the circumferential direction. The first grooves are less than the second grooves in one or more of a number of grooves, a depth of each groove, and a lead angle of each groove.

11 Claims, 6 Drawing Sheets

(51) Int. Cl.

| | |
|---|---|
| ***F25B 39/04*** | (2006.01) |
| ***F28F 1/40*** | (2006.01) |
| ***F28F 13/18*** | (2006.01) |

(52) U.S. Cl.
CPC ..... *F28F 13/187* (2013.01); *F25B 2500/01* (2013.01)

(56) References Cited

FOREIGN PATENT DOCUMENTS

| | | | |
|---|---|---|---|
| JP | 58-174668 | U | 11/1983 |
| JP | H01-061561 | U | 4/1989 |
| JP | 2000-329486 | A | 11/2000 |
| JP | 2001-330388 | A | 11/2001 |
| JP | 2005-127570 | A | 5/2005 |
| JP | 2007-263492 | A | 10/2007 |

OTHER PUBLICATIONS

Japanese Office Action dated May 24, 2022 issued in corresponding Japanese Patent Application No. 2020-557097 (and English Translation).
International Search Report dated Feb. 5, 2019, issued in corresponding International Application PCT/JP2018/043145.
Office Action dated Nov. 9, 2022 issued in corresponding CN Patent Application No. 201880099441.8 (and English translation).
Office Action dated May 26, 2022 issued in corresponding CN Patent Application No. 201880099441.8 (and English translation).
Office Action dated Mar. 24, 2023 issued in corresponding CN Patent Application No. 201880099441.8 (and English translation).

* cited by examiner

HEAT EXCHANGER AND REFRIGERATION CYCLE APPARATUS

CROSS REFERENCE TO RELATED APPLICATION

This application is a U.S. National Stage Application of International Application PCT/JP2018/043145, filed on Nov. 22, 2018, the contents of which are incorporated herein by reference.

TECHNICAL FIELD

The present invention relates to a heat exchanger and a refrigeration cycle apparatus.

BACKGROUND

Japanese Patent Laying-Open No. 2007-263492 discloses a heat exchanger in which a refrigerant pipe positioned at an upper portion is a grooved pipe portion provided with grooves in its inner surface, and a refrigerant pipe positioned at a lower portion is a smooth pipe portion not provided with grooves in its inner surface. A single grooved pipe portion is connected in series with a single smooth pipe portion.

PATENT LITERATURE

PTL 1: Japanese Patent Laying-Open No. 2007-263492

In the heat exchanger described above, the smooth pipe portion not provided with grooves has a pressure loss lower than the grooved pipe portion provided with grooves.

In the heat exchanger described above, however, the smooth pipe portion not provided with grooves also has heat exchange performance lower than heat exchange performance of the grooved pipe portion provided with grooves.

Accordingly, the heat exchanger described above has a higher pressure loss than a heat exchanger including a heat transfer tube formed of only a smooth pipe portion, and has lower heat exchange performance than a heat exchanger including a heat transfer tube formed of only a grooved pipe portion.

SUMMARY

A main object of the present invention is to provide a heat exchanger and a refrigeration cycle apparatus, the heat exchanger being such that reduction in heat exchange performance is suppressed in the entire heat exchanger, while pressure loss of refrigerant is reduced in the entire heat exchanger, as compared to a conventional heat exchanger.

A refrigeration cycle apparatus according to the present invention includes a heat transfer tube. The heat transfer tube includes a first tube portion, and a plurality of second tube portions connected in parallel with each other with respect to the first tube portion. The first tube portion has a first inner circumferential surface, and at least one first groove recessed relative to the first inner circumferential surface and arranged side by side in a circumferential direction of the heat transfer tube. The plurality of second tube portions each have a second inner circumferential surface, and at least one second groove recessed relative to the second inner circumferential surface and arranged side by side in the circumferential direction. The at least one first groove is less than the at least one second groove in at least one of a number of grooves, a depth of each groove, and a lead angle of each groove.

According to the present invention, a heat exchanger and a refrigeration cycle apparatus can be provided, the heat exchanger being such that reduction in heat exchange performance is suppressed in the entire heat exchanger, while pressure loss of refrigerant is reduced in the entire heat exchanger, as compared to a conventional heat exchanger.

DETAILED DESCRIPTION

Figure 1:
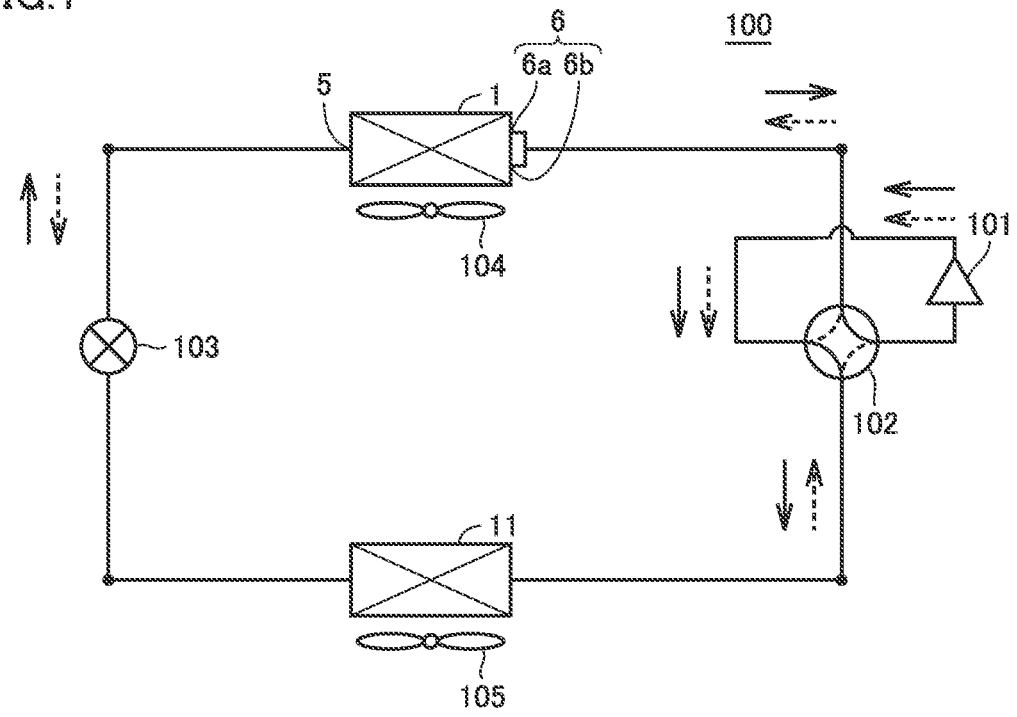
FIG. 1 shows a refrigeration cycle apparatus according to a first embodiment.

Embodiments of the present invention will be described hereinafter in detail with reference to the drawings. The same or corresponding parts in the drawings are designated by the same characters and a description thereof will not be repeated in principle.

First Embodiment

<Configuration of Refrigeration Cycle Apparatus>

As shown in FIG. 1, a refrigeration cycle apparatus 100 according to a first embodiment includes a refrigerant circuit through which refrigerant circulates. The refrigerant circuit includes a compressor 101, a four-way valve 102 as a flow path switching unit, a decompression unit 103, a first heat exchanger 1, and a second heat exchanger 11. Refrigeration cycle apparatus 100 further includes a first fan 104 that blows air to first heat exchanger 1, and a second fan 105 that blows air to second heat exchanger 11.

Compressor 101 has a discharge port through which to discharge the refrigerant, and a suction port through which to suck the refrigerant. Decompression unit 103 is an expansion valve, for example. Decompression unit 103 is connected to a first inlet/outlet portion 5 of first heat exchanger 1.

Four-way valve 102 has a first opening P1 connected to the discharge port of compressor 101 via a discharge pipe, a second opening P2 connected to the suction port of compressor 101 via a suction pipe, a third opening P3 connected to a second inlet/outlet portion 6*a* and a third inlet/outlet portion 6*b* of first heat exchanger 1, and a fourth opening P4 connected to second heat exchanger 11. Four-way valve 102 is provided to switch between a first state in which first heat exchanger 1 serves as a condenser and second heat exchanger 11 serves as an evaporator, and a second state in which second heat exchanger 11 serves as a condenser and first heat exchanger 1 serves as an evaporator. Note that solid line arrows shown in FIG. 1 indicate a flow direction of the refrigerant circulating through the refrigerant circuit when refrigeration cycle apparatus 100 is in the first state. Dotted line arrows shown in FIG. 1 indicate a flow direction of the refrigerant circulating through the refrigerant circuit when refrigeration cycle apparatus 100 is in the second state.

<Configuration of First Heat Exchanger>

Figure 2:
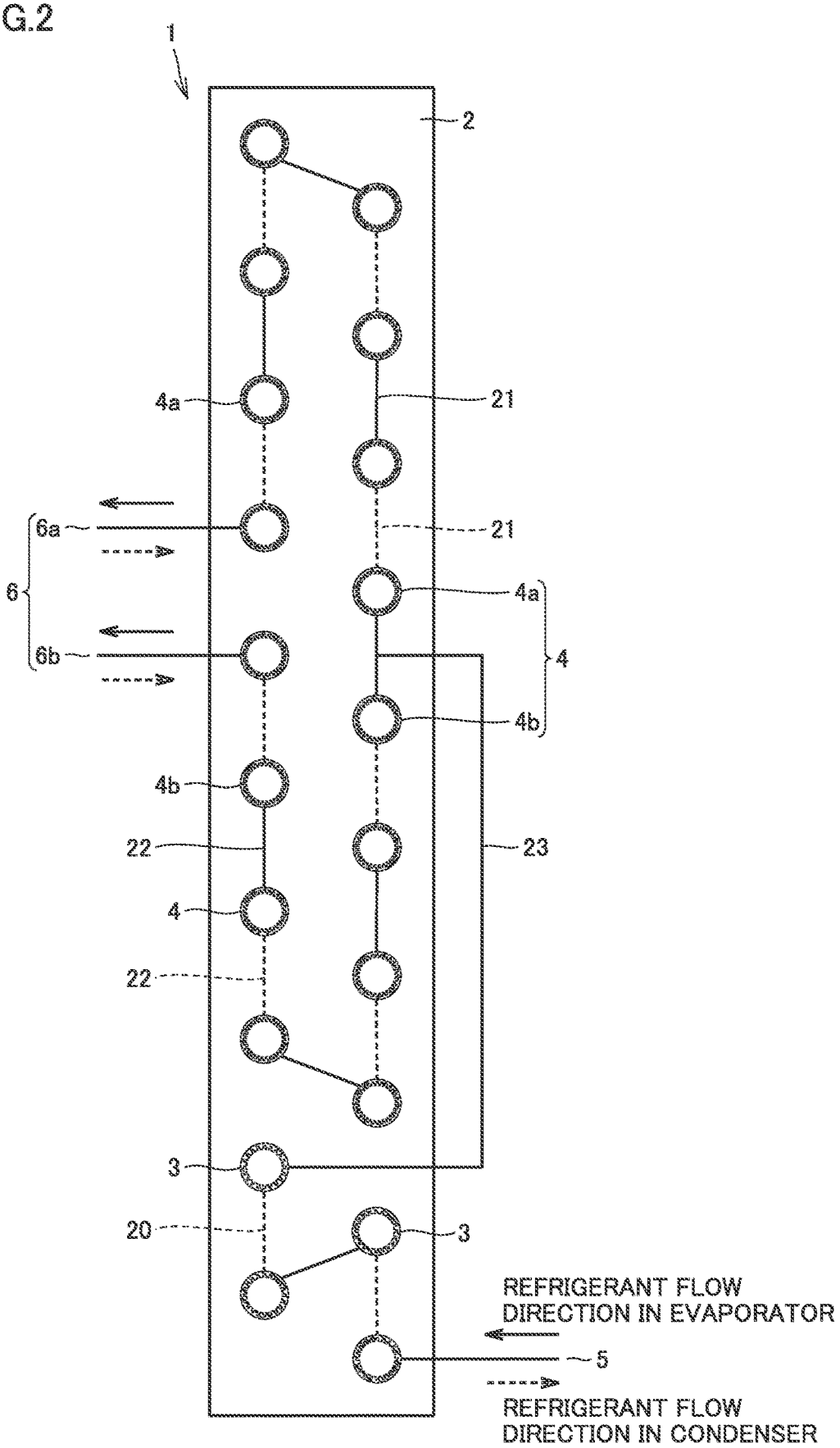
FIG. 2 shows a heat exchanger according to the first embodiment.

As shown in FIG. 2, first heat exchanger 1 mainly includes a plurality of fins 2 and a plurality of heat transfer tubes 3, 4, for example. First heat exchanger 1 is provided such that gas flowing toward a direction along the plurality of fins 2 exchanges heat with the refrigerant flowing through the plurality of heat transfer tubes 3, 4.

The plurality of heat transfer tubes 3, 4 include a plurality of first tube portions 3 and a plurality of second tube portions 4. Each first tube portion 3 has an outer diameter equal to an outer diameter of each second tube portion 4.

The plurality of first tube portions 3 are connected in series with one another via first connection portions 20. The plurality of second tube portions 4 have a first group of second tube portions 4*a* connected in series with one another via second connection portions 21, and a second group of second tube portions 4*b* connected in series with one another via a plurality of third connection portions 22. The first group of second tube portions 4*a* and the second group of second tube portions 4*b* are each connected in series with the plurality of first tube portions 3 via a fourth connection portion 23. The first group of second tube portions 4*a* and the second group of second tube portions 4*b* are connected in parallel with each other via fourth connection portion 23. First connection portions 20, second connection portions 21, and third connection portions 22 are each configured as a connection pipe that connects two inlet/outlet ports in series. Fourth connection portion 23 is configured as a diverging pipe that connects two or more inlet/outlet ports in parallel with one inlet/outlet port. In FIG. 2, first connection portion 20, second connection portion 21, and third connection portion 22 indicated by solid lines are connected to one ends of the plurality of heat transfer tubes 3, 4, while first connection portion 20, second connection portion 21, and third connection portion 22 indicated by dotted lines are connected to the other ends of the plurality of heat transfer tubes 3, 4.

The plurality of first tube portions 3 connected in series with one another via first connection portions 20 form a first refrigerant flow path. The first group of second tube portions 4*a* connected in series with one another via second connection portions 21 form a second refrigerant flow path. The second group of second tube portions 4*b* connected in series with one another via third connection portions 22 form a third refrigerant flow path. The second refrigerant flow path and the third refrigerant flow path form branched paths diverging from the first refrigerant flow path.

The first refrigerant flow path has one end connected to decompression unit 103 via first inlet/outlet portion 5. The first refrigerant flow path has the other end connected to one end of the second refrigerant flow path and one end of the third refrigerant flow path via fourth connection portion 23. The second refrigerant flow path has the other end connected to third opening P3 in four-way valve 102 via second inlet/outlet portion 6*a*. The third refrigerant flow path has the other end connected to third opening P3 in four-way valve 102 via third inlet/outlet portion 6*b*.

Figure 3:
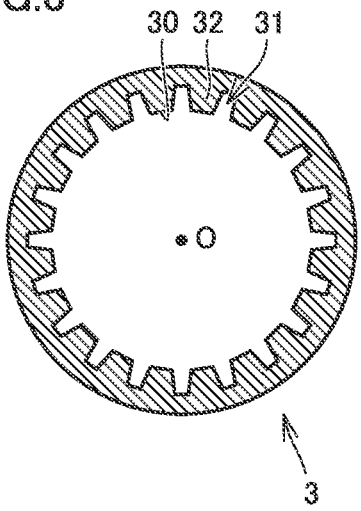
FIG. 3 is a cross-sectional view showing a first tube portion of a heat transfer tube of the heat exchanger shown in FIG. 2.

Each first tube portion 3 has a similar configuration. As shown in FIG. 3, each first tube portion 3 has a first inner circumferential surface 30 and a plurality of first grooves 31. First inner circumferential surface 30 is a surface that makes contact with the refrigerant flowing through first tube portion 3. Each first groove 31 is recessed relative to first inner circumferential surface 30. Each of the plurality of first grooves 31 has a similar configuration, for example. First grooves 31 are spaced from one another in the circumferential direction of first tube portion 3. Each first groove 31 is provided in spiral form with respect to a central axis O of first tube portion 3. Each first groove 31 intersects the radial direction of first tube portion 3. Each first groove 31 is provided such that its width in the circumferential direction decreases toward the outer circumference of first tube portion 3 in the radial direction, for example.

Figure 4:
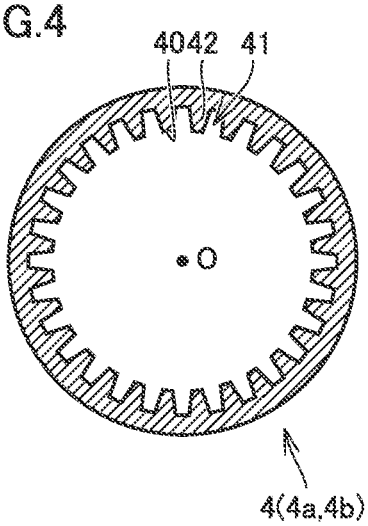
FIG. 4 is a cross-sectional view showing a second tube portion of the heat transfer tube of the heat exchanger shown in FIG. 2.

Each second tube portion 4 has a similar configuration. In other words, each of the first group of second tube portions 4*a* and each of the second group of second tube portions 4*b* have a similar configuration. As shown in FIG. 4, each second tube portion 4 has a second inner circumferential surface 40 and a plurality of second grooves 41. Second inner circumferential surface 40 is a surface that makes contact with the refrigerant flowing through second tube portion 4. Each second groove 41 is recessed relative to second inner circumferential surface 40. Each of the plurality of second grooves 41 has a similar configuration, for example. Second grooves 41 are spaced from one another in the circumferential direction of second tube portion 4. Each second groove 41 is provided in spiral form with respect to central axis O of second tube portion 4. Each second groove 41 intersects the radial direction of second tube portion 4. Each second groove 41 is provided such that its width in the circumferential direction decreases toward the outer circumference of second tube portion 4 in the radial direction, for example.

As shown in FIG. 3, the number of first grooves 31 is defined as the number of first grooves 31 arranged side by side in the circumferential direction in a cross section perpendicular to the axial direction of first tube portion 3. As shown in FIG. 4, the number of second grooves 41 is defined as the number of second grooves 41 arranged side by side in the circumferential direction in a cross section perpendicular to the axial direction of second tube portion 4. The number of first grooves 31 is less than the number of second grooves 41. Stated another way, the width of each first groove 31 in the circumferential direction is greater than the width of each second groove 41 in the circumferential direction.

The depth of each first groove 31 (described later in detail) is equal to the depth of each second groove 41, for example. The lead angle of each first groove 31 (described later in detail) is equal to the lead angle of each second groove 41, for example.

<Flow of Refrigerant Through First Heat Exchanger 1>

When refrigeration cycle apparatus 100 is in the first state, first heat exchanger 1 serves as a condenser. In this case, second inlet/outlet portion 6*a* and third inlet/outlet portion 6*b* are connected in parallel with each other with respect to the discharge port of compressor 101. Thus, some of the refrigerant discharged from compressor 101 flows into the second refrigerant flow path through second inlet/outlet portion 6*a*, and the rest of the refrigerant flows into the third refrigerant flow path through third inlet/outlet portion 6*b*. The refrigerant that has flowed into the second refrigerant flow path exchanges heat with air and condenses while flowing through the first group of second tube portions 4*a*, to gradually decrease in its degree of dryness. The refrigerant that has flowed into the third refrigerant flow path exchanges heat with air and condenses while flowing through the second group of second tube portions 4*b*, to gradually decrease in its degree of dryness. The refrigerants that have flowed through the second refrigerant flow path and the third refrigerant flow path merge and flow into the first refrigerant flow path. The refrigerant that has flowed into the first refrigerant flow path exchanges heat with air and condenses while flowing through first tube portions 3, to further decrease in its degree of dryness. The refrigerant that has flowed through the first refrigerant flow path flows out of first heat exchanger 1 through first inlet/outlet portion 5, and flows into decompression unit 103.

When refrigeration cycle apparatus 100 is in the second state, first heat exchanger 1 serves as an evaporator. In this case, all of the refrigerant decompressed in decompression unit 103 flows into the first refrigerant flow path through first inlet/outlet portion 5. The refrigerant that has flowed into the first refrigerant flow path exchanges heat with air and evaporates while flowing through first tube portions 3, to gradually increase in its degree of dryness. The refrigerant that has flowed through the first refrigerant flow path is branched so that some of the refrigerant flows into the second refrigerant flow path, and the rest of the refrigerant flows into the third refrigerant flow path. The refrigerant that has flowed into the second refrigerant flow path exchanges heat with air and further evaporates while flowing through the first group of second tube portions 4*a*, to further increase in the degree of dryness. The refrigerant that has flowed into the third refrigerant flow path exchanges heat with air and further evaporates while flowing through the second group of second tube portions 4*b*, to further increase in the degree of dryness. The refrigerant that has flowed through each of the second refrigerant flow path and the third refrigerant flow path flows out of first heat exchanger 1 through second inlet/outlet portion 6*a* and third inlet/outlet portion 6*b*, and flows into the suction port of compressor 101.

<Performance of Heat Exchange Between Refrigerant and Air in First Heat Exchanger 1>

Performance of heat exchange between refrigerant and air increases with an increase in area of a surface of a heat transfer tube that makes contact with the refrigerant.

Surfaces of first tube portion 3 that make contact with the refrigerant are first inner circumferential surface 30 and inner surfaces of first grooves 31. Surfaces of second tube portion 4 that make contact with the refrigerant are inner circumferential surface 40 and inner surfaces of second grooves 41. The outer diameter of second tube portion 4 is equal to the outer diameter of first tube portion 3, and the number of second grooves 41 is higher than the number of first grooves 31. Thus, the sum of the areas of second inner circumferential surface 40 and the inner surfaces of second grooves 41 of second tube portion 4 is greater than the sum of the areas of first inner circumferential surface 30 and the inner surfaces of first grooves 31, and the performance of heat exchange between the refrigerant and air in second tube portion 4 is improved as compared to the performance of heat exchange between the refrigerant and air in first tube portion 3.

In this manner, the performance of heat exchange between the refrigerant and air in first heat exchanger 1 is improved as compared to the performance of heat exchange between the refrigerant and air in a heat exchanger in which the entire heat transfer tube is a grooved tube similar to first tube portion 3.

<Pressure Loss of Refrigerant in First Heat Exchanger 1>

Pressure loss of refrigerant increases with an increase in specific volume of the refrigerant, and with an increase in flow rate of the refrigerant. Further, pressure loss of refrigerant increases with an increase in flow path resistance of a heat transfer tube through which the refrigerant flows.

In the first state, the refrigerant that has been discharged from compressor 101 and having a high degree of dryness flows into second tube portion 4, and the refrigerant that has condensed and decreased in the degree of dryness in second tube portion 4 flows into first tube portion 3. Thus, the specific volume of the refrigerant flowing through each second tube portion 4 is higher than the specific volume of the refrigerant flowing through each first tube portion 3. Further, because the number of second grooves 41 is higher than the number of first grooves 31, the flow path resistance of second tube portion 4 is higher than the flow path resistance of first tube portion 3. On the other hand, the flow rate of the refrigerant flowing through each second tube portion 4 is lower than, for example, about one-half of, the flow rate of the refrigerant flowing through each first tube portion 3.

In other words, the specific volume of the refrigerant flowing through each second tube portion 4 and the flow path resistance of each second tube portion 4 caused by second grooves 41 are higher than the specific volume of the refrigerant flowing through each first tube portion 3 and the flow path resistance of each first tube portion 3 caused by first grooves 31. In contrast, the flow rate through each second tube portion 4 is lower than the flow rate through each first tube portion 3. Thus, increase in pressure loss of the refrigerant in each second tube portion 4 is suppressed.

On the other hand, the flow rate through each first tube portion 3 is higher than the flow rate through each second tube portion 4. In contrast, the specific volume of the refrigerant flowing through each first tube portion 3 and the flow path resistance of each first tube portion 3 caused by first grooves 31 are lower than the specific volume of the refrigerant flowing through each second tube portion 4 and the flow path resistance of each second tube portion 4 caused by second grooves 41. Thus, increase in pressure loss of the refrigerant in each first tube portion 3 is suppressed.

In the second state, the refrigerant that has been decompressed in decompression unit 103 and having a low degree of dryness flows into first tube portion 3. The refrigerant that has evaporated and increased in the degree of dryness in first tube portion 3 is branched and then flows into second tube portion 4. Thus, while the flow rate of the refrigerant through each first tube portion 3 is higher than the flow rate of the refrigerant through each second tube portion 4, the specific volume of the refrigerant flowing through each first tube portion 3 is lower than the specific volume of the refrigerant flowing through each second tube portion 4. Further, because the number of first grooves 31 is lower than the number of second grooves 41, the flow path resistance of first tube portion 3 is lower than the flow path resistance of second tube portion 4.

In other words, the flow rate through each first tube portion 3 is lower than the flow rate through each second tube portion 4. In contrast, the specific volume of the refrigerant flowing through each first tube portion 3 and the flow path resistance of each first tube portion 3 caused by first grooves 31 are lower than the specific volume of the refrigerant flowing through each second tube portion 4 and the flow path resistance of each second tube portion 4 caused by second grooves 41. Thus, increase in pressure loss of the refrigerant in each first tube portion 3 is suppressed.

On the other hand, the specific volume of the refrigerant flowing through each second tube portion 4 and the flow path resistance of each second tube portion 4 caused by second grooves 41 are higher than the specific volume of the refrigerant flowing through each first tube portion 3 and the flow path resistance of each first tube portion 3 caused by first grooves 31. In contrast, the flow rate through each second tube portion 4 is lower than the flow rate through each first tube portion 3. Thus, increase in pressure loss of the refrigerant in each second tube portion 4 is suppressed.

In this manner, in the first state and the second state, the pressure loss of the refrigerant in entire first heat exchanger 1 is kept relatively low. In particular, the pressure loss of the refrigerant in entire first heat exchanger 1 is kept lower than the pressure loss of the refrigerant in the entire heat exchanger in which the entire heat transfer tube is a grooved tube similar to the second tube portion.

As described above, first heat exchanger 1 has higher heat exchange performance than a heat exchanger in which the entire heat transfer tube is a grooved tube similar to first tube portion 3, and has a pressure loss of the refrigerant that is kept lower than that of a heat exchanger in which the entire heat transfer tube is a grooved tube similar to the second tube portion. In other words, in first heat exchanger 1, reduction in heat exchange performance is suppressed in the entire heat exchanger, while pressure loss of the refrigerant is reduced in the entire heat exchanger, as compared to a conventional heat exchanger.

In first heat exchanger 1, first tube portion 3 is equal to second tube portion 4 in outer diameter, and the outer diameters of heat transfers tube 3, 4 are constant regardless of the location. The diameter of each through hole in fin 2 through which each of first tube portion 3 and second tube portion 4 is inserted is also constant. Thus, first heat exchanger 1 is readily assembled as compared to, for example, a heat exchanger in which the outer diameter and inner diameter of a heat transfer tube are varied with location in order to reduce pressure loss.

By including first heat exchanger 1 described above, refrigeration cycle apparatus 100 is more efficient than a conventional refrigeration cycle apparatus.

Second Embodiment

A refrigeration cycle apparatus and a first heat exchanger according to a second embodiment are basically similar in configuration to refrigeration cycle apparatus 100 and first heat exchanger 1 according to the first embodiment, but are different in that the depth of each first groove 31 is less than the depth of each second groove 41.

In the first heat exchanger according to the second embodiment, the number of first grooves 31 in the cross section perpendicular to the axial direction of first tube portion 3 is equal to the number of second grooves 41 in the cross section perpendicular to the axial direction of second tube portion 4, for example.

Figure 5:
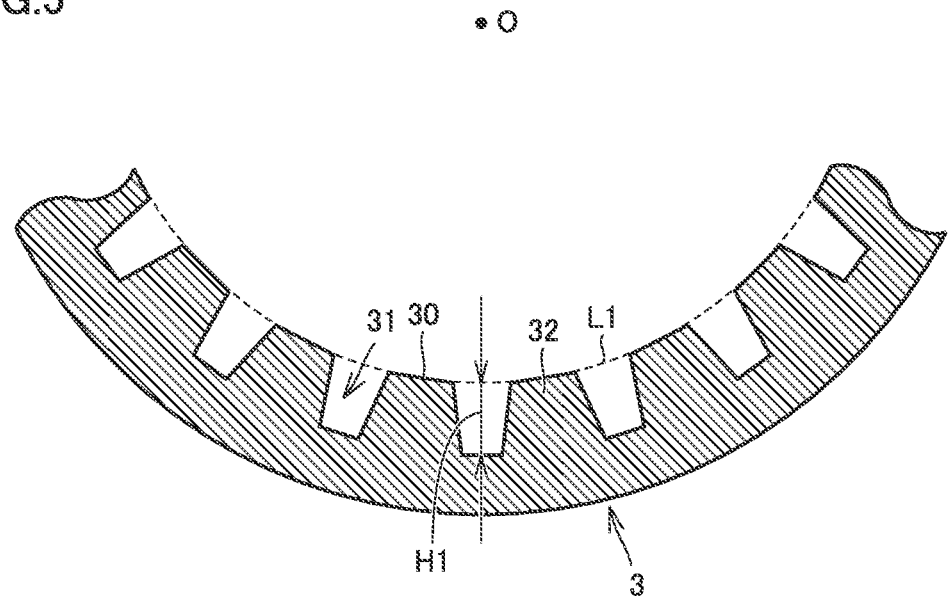
FIG. 5 is a cross-sectional view showing a first tube portion of a heat transfer tube of a heat exchanger according to a second embodiment.
Figure 6:
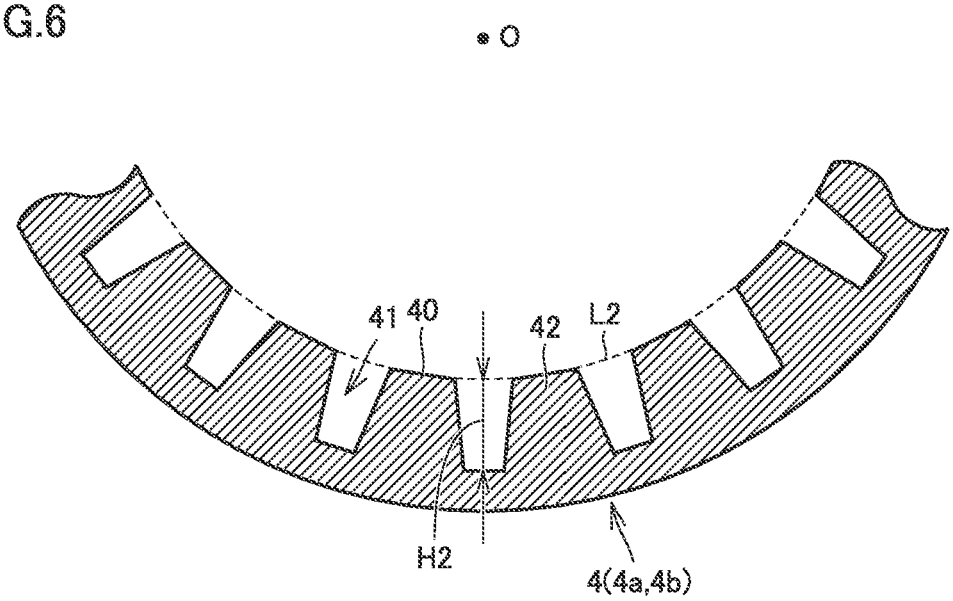
FIG. 6 is a cross-sectional view showing a second tube portion of the heat transfer tube of the heat exchanger according to the second embodiment.

As shown in FIG. 5, a depth H1 of first groove 31 is defined as the distance between an imaginary line L1 extended from first inner circumferential surface 30 and the inner surface of first groove 31, at the center of first groove 31 in the circumferential direction. Depth H1 of each first groove 31 is equal. As shown in FIG. 6, a depth H2 of second groove 41 is defined as the distance between an imaginary line L2 extended from second inner circumferential surface 40 and the inner surface of second groove 41, at the center of second groove 41 in the circumferential direction. Depth H2 of each second groove 41 is equal.

In the first heat exchanger according to the second embodiment, depth H1 of each first groove 31 is less than depth H2 of each second groove 41. The area of the inner surfaces of first grooves 31 is less than the area of the inner surfaces of second grooves 41. Thus, as in first heat exchanger 1 according to the first embodiment, also in the first heat exchanger according to the second embodiment, the performance of heat exchange between the refrigerant and air in second tube portion 4 is improved as compared to the performance of heat exchange between the refrigerant and air in first tube portion 3.

In addition, the flow path resistance of second tube portion 4 is higher than the flow path resistance of first tube portion 3. Thus, as in first heat exchanger 1 according to the first embodiment, also in the first heat exchanger according to the second embodiment, increase in pressure loss of the refrigerant in each second tube portion 4 is suppressed.

In this manner, the first heat exchanger according to the second embodiment can produce similar effects to those of first heat exchanger 1 according to the first embodiment.

As in first heat exchanger 1 according to the first embodiment, also in the first heat exchanger according to the second embodiment, the number of first grooves 31 in the cross section perpendicular to the axial direction of first tube portion 3 may be less than the number of second grooves 41 in the cross section perpendicular to the axial direction of second tube portion 4, for example. In such a first heat exchanger, the difference in flow path resistance between first tube portion 3 and second tube portion 4 required to reduce the pressure loss of the refrigerant in the entire first heat exchanger is designed by the difference in each of two parameters, which are the numbers and the depths of first grooves 31 and second grooves 41. Therefore, even when it is difficult to design the difference in flow path resistance only by the difference in one of the two parameters, for example, the difference in flow path resistance is relatively readily achieved.

Third Embodiment

A refrigeration cycle apparatus and a first heat exchanger according to a third embodiment are basically similar in configuration to refrigeration cycle apparatus 100 and first heat exchanger 1 according to the first embodiment, but are different in that the lead angle of each first groove 31 is less than the lead angle of each second groove 41.

In the first heat exchanger according to the third embodiment, the number of first grooves 31 in the cross section perpendicular to the axial direction of first tube portion 3 is equal to the number of second grooves 41 in the cross section perpendicular to the axial direction of second tube portion 4, for example. In addition, in the first heat exchanger according to the third embodiment, depth H1 of each first groove 31 is equal to depth H2 of each second groove 41, for example.

Figure 7:
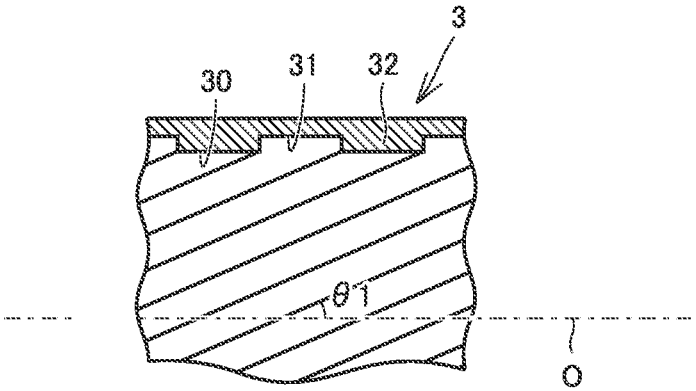
FIG. 7 is a cross-sectional view showing a first tube portion of a heat transfer tube of a heat exchanger according to a third embodiment.

As shown in FIG. 7, a lead angle θ1 of first groove 31 is defined as the angle formed by a direction in which first groove 31 extends with respect to central axis O of first tube portion 3. Lead angle θ1 of each first groove 31 is equal.

Figure 8:
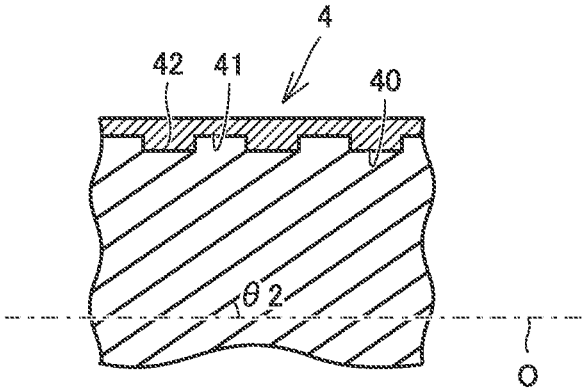
FIG. 8 is a cross-sectional view showing a second tube portion of the heat transfer tube of the heat exchanger according to the third embodiment.

As shown in FIG. 8, a lead of second groove 41 is defined as the angle formed by a direction in which second groove 41 extends with respect to central axis O of second tube portion 4. Lead of each second groove 41 is equal.

In the first heat exchanger according to the third embodiment, lead angle θ1 of each first groove 31 is less than lead of each second groove 41. The length of each such first groove 31 in the extension direction is less than the length of each second groove 41 in the extension direction. Thus, when the number and the depth of first grooves 31 are equal to or less than the number and the depth of second grooves 41, the area of the inner surfaces of first grooves 31 is less than the area of the inner surfaces of second grooves 41. Thus, as in first heat exchanger 1 according to the first embodiment, also in the first heat exchanger according to the third embodiment, the performance of heat exchange between the refrigerant and air in second tube portion 4 is improved as compared to the performance of heat exchange between the refrigerant and air in first tube portion 3.

In addition, the flow path resistance of second tube portion 4 is higher than the flow path resistance of first tube portion 3. Thus, as in first heat exchanger 1 according to the first embodiment, also in the first heat exchanger according to the third embodiment, increase in pressure loss of the refrigerant in each second tube portion 4 is suppressed.

In this manner, the first heat exchanger according to the third embodiment can produce similar effects to those of first heat exchanger 1 according to the first embodiment.

As in first heat exchanger 1 according to the first embodiment, also in the first heat exchanger according to the third embodiment, the number of first grooves 31 in the cross section perpendicular to the axial direction of first tube portion 3 may be less than the number of second grooves 41 in the cross section perpendicular to the axial direction of second tube portion 4, for example. In such a first heat exchanger, the difference in flow path resistance between first tube portion 3 and second tube portion 4 required to reduce the pressure loss of the refrigerant in the entire first heat exchanger is designed by the difference in each of two parameters, which are the numbers and the depths of first grooves 31 and second grooves 41. Therefore, even when it is difficult to design the difference in flow path resistance only by the difference in one of the two parameters, for example, the difference in flow path resistance is relatively readily achieved.

As in first heat exchanger 1 according to the second embodiment, also in the first heat exchanger according to the third embodiment, depth H1 of each first groove 31 may be less than depth H2 of each second groove 41. In such a first heat exchanger, the difference in flow path resistance between first tube portion 3 and second tube portion 4 required to reduce the pressure loss of the refrigerant in the entire first heat exchanger is designed by the difference in each of two parameters, which are the depths and the lead angles of first grooves 31 and second grooves 41. Therefore, even when it is difficult to design the difference in flow path resistance only by the difference in one of the two parameters, for example, the difference in flow path resistance is relatively readily achieved.

Fourth Embodiment

A refrigeration cycle apparatus and a first heat exchanger according to a fourth embodiment are basically similar in configuration to refrigeration cycle apparatus 100 and first heat exchanger 1 according to the first embodiment, but are different in that the number of first grooves 31 is less than the number of second grooves 41, depth H1 of each first groove 31 is less than depth H2 of each second groove 41, and lead angle θ1 of each first groove 31 is less than lead angle θ2 of each second groove 41.

The first heat exchanger according to the fourth embodiment is also basically similar in configuration to the first heat exchangers according to the first to third embodiments described above, and can thus produce similar effects to those of the first heat exchangers according to the first to third embodiments.

In addition, in the first heat exchanger according to the fourth embodiment, the difference in flow path resistance between first tube portion 3 and second tube portion 4 required to reduce the pressure loss of the refrigerant in the entire first heat exchanger is designed by the difference in each of three parameters, which are the numbers, the depths, and the lead angles of first grooves 31 and second grooves 41. Therefore, even when it is difficult to design the difference in flow path resistance only by the difference in one or two of the three parameters, for example, the difference in flow path resistance is relatively readily achieved.

As described above, in the first heat exchangers according to the first to fourth embodiments, at least one of the number, the depth, and the lead angle of the plurality of first grooves 31 is less than at least one of the number, the depth, and the lead angle of the plurality of second grooves 41.

Fifth Embodiment

A refrigeration cycle apparatus and a first heat exchanger according to a fifth embodiment are basically similar in configuration to refrigeration cycle apparatus 100 and first heat exchanger 1 according to the first embodiment, but are different in further including a plurality of third tube portions 7 connected in parallel with each of the plurality of second tube portions 4.

The plurality of third tube portions 7 have a first group of third tube portions 7*a* connected in series with each other via a fifth connection portion 24, a second group of third tube portions 7*b* connected in series with each other via a sixth connection portion 25, a third group of third tube portions 7*c* connected in series with each other via a seventh connection portion 26, and a fourth group of third tube portions 7*d* connected in series with each other via an eighth connection portion 27.

The first group of third tube portions 7*a* and the second group of third tube portions 7*b* are each connected in series with the first group of second tube portions 4*a* via a ninth connection portion 28. The first group of third tube portions 7*a* and the second group of third tube portions 7*b* are connected in parallel with each other via ninth connection portion 28.

The third group of third tube portions 7*c* and the fourth group of third tube portions 7*d* are each connected in series with the second group of second tube portions 4*b* via a tenth connection portion 29. The third group of third tube portions 7*c* and the fourth group of third tube portions 7*d* are connected in parallel with each other via tenth connection portion 29.

Figure 9:
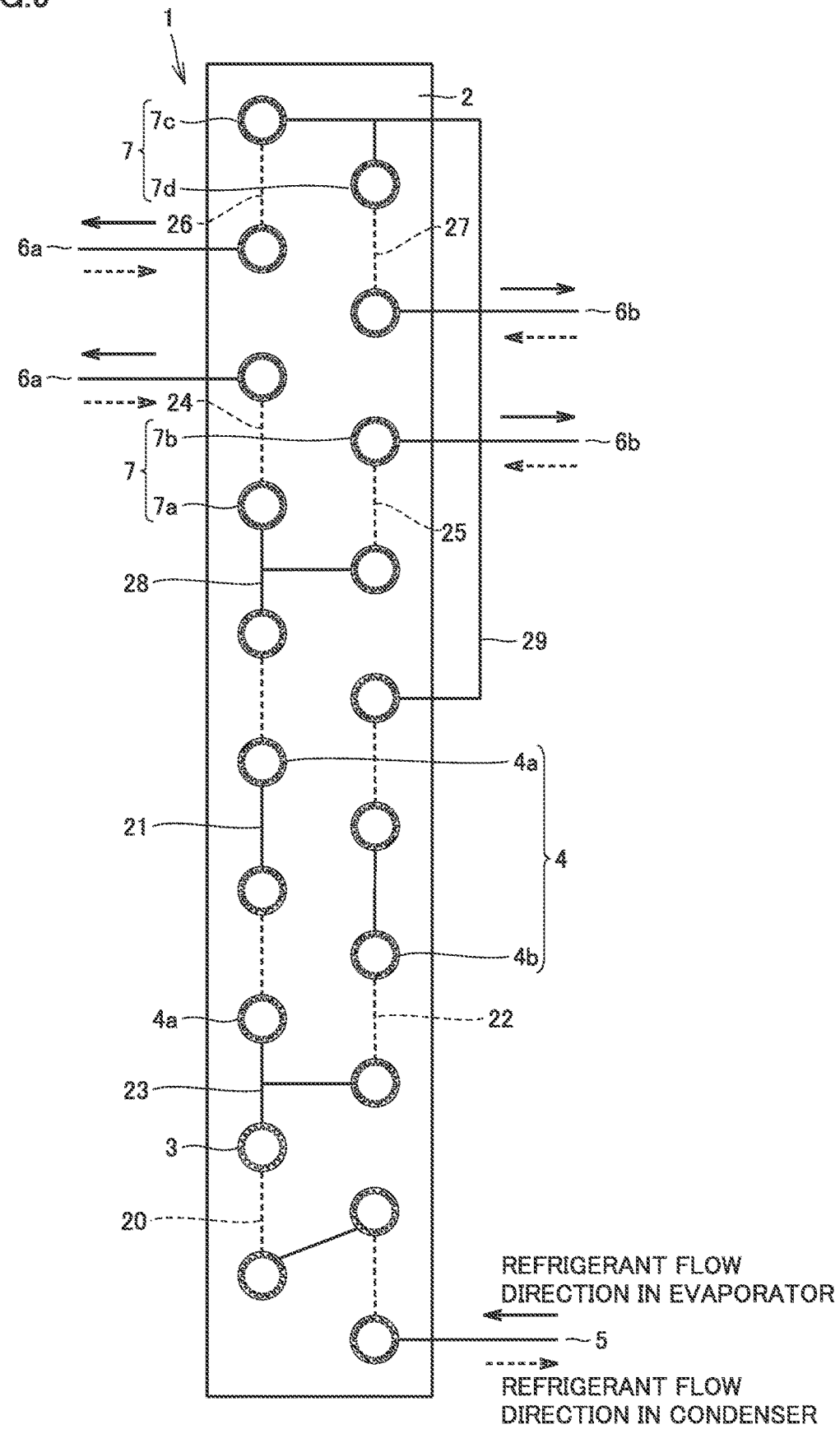
FIG. 9 shows a heat exchanger according to a fifth embodiment.

Fifth connection portion 24, sixth connection portion 25, seventh connection portion 26, and eighth connection portion 27 are each configured as a connection pipe that connects two inlet/outlet ports in series. Ninth connection portion 28 and tenth connection portion 29 are each configured as a diverging pipe that connects two or more inlet/outlet ports in parallel with one inlet/outlet port. In FIG. 9, first connection portion 20, second connection portion 21, third connection portion 22, fifth connection portion 24, sixth connection portion 25, seventh connection portion 26, and eighth connection portion 27 indicated by solid lines are connected to one ends of the plurality of heat transfer tubes 3, 4, 7, while first connection portion 20, second connection portion 21, third connection portion 22, fifth connection portion 24, sixth connection portion 25, seventh connection portion 26, and eighth connection portion 27 indicated by dotted lines are connected to the other ends of the plurality of heat transfer tubes 3, 4, 7.

The first group of third tube portions 7*a* forms a fourth refrigerant flow path. The second group of third tube portions 7*b* forms a fifth refrigerant flow path. The fourth refrigerant flow path and the fifth refrigerant flow path form branched paths diverging from the second refrigerant flow path.

The third group of third tube portions 7*c* forms a sixth refrigerant flow path. The fourth group of third tube portions 7*d* forms a seventh refrigerant flow path. The sixth refrigerant flow path and the seventh refrigerant flow path form branched paths diverging from the third refrigerant flow path.

The first refrigerant flow path has one end connected to decompression unit 103 via first inlet/outlet portion 5. The first refrigerant flow path has the other end connected to one end of the second refrigerant flow path and one end of the third refrigerant flow path via fourth connection portion 23. The second refrigerant flow path has the other end connected to one end of the fourth refrigerant flow path and one end of the fifth refrigerant flow path via ninth connection portion 28. The third refrigerant flow path has the other end connected to one end of the sixth refrigerant flow path and one end of the seventh refrigerant flow path via tenth connection portion 29.

The fourth refrigerant flow path and the sixth refrigerant flow path each have the other end connected to third opening P3 in four-way valve 102 via second inlet/outlet portion 6*a*. The fifth refrigerant flow path and the seventh refrigerant flow path each have the other end connected to third opening P3 in four-way valve 102 via third inlet/outlet portion 6*b*.

Each third tube portion 7 has a similar configuration. In other words, each of the first to fourth groups of third tube portions 7*a*, 7*b*, 7*c*, 7*d* has a similar configuration. Each third tube portion 7 has a third inner circumferential surface 70 and a plurality of third grooves 71. Third inner circumferential surface 70 is a surface that makes contact with the refrigerant flowing through third tube portion 7. Each third groove 71 is recessed relative to third inner circumferential surface 70. Each of the plurality of third grooves 71 has a similar configuration, for example. Third grooves 71 are spaced from one another in the circumferential direction of first tube portion 3. Each third groove 71 is provided in spiral form with respect to central axis O of third tube portion 7. Each third groove 71 intersects the radial direction of third tube portion 7. Each third groove 71 is provided such that its width in the circumferential direction decreases toward the outer circumference of third tube portion 7 in the radial direction, for example.

Second tube portion 4 and third tube portion 7 have a relationship with each other similar to that between first tube portion 3 and second tube portion 4 in any of the first to fourth embodiments. In other words, at least one of the number, the depth, and the lead angle of second grooves 41 is less than at least one of the number, the depth, and the lead angle of third grooves 71. Note that the number, the depth, and the lead angle of third grooves 71 are defined similarly to the numbers, the depths, and the lead angles of first grooves 31 and second grooves 41, respectively.

The number of second grooves 41 exceeds the number of first grooves 31, and is less than the number of third grooves 71, for example. In other words, any one of the parameters including the number, the depth and the lead angle that satisfies the above-described relationship of magnitude between first grooves 31 and second grooves 41 is the same as a parameter that satisfies the above-described relationship of magnitude between second grooves 41 and third grooves 71. In other words, first grooves 31, second grooves 41 and third grooves 71 are provided such that any one of these parameters including the number, the depth and the lead angle satisfies the above-described two-stage relationship of magnitude, for example. Alternatively, the number of second grooves 41 may exceed the number of first grooves 31, and the depth of second grooves 41 may be less than the depth of the plurality of third grooves 71. In other words, any one of the parameters including the number, the depth and the lead angle that satisfies the above-described relationship of magnitude between first grooves 31 and second grooves 41 may be different from a parameter that satisfies the above-described relationship of magnitude between second grooves 41 and third grooves 71. In the above-described case, the number of second grooves 41 may be equal to the number of third grooves 71. In other words, second grooves 41 and third grooves 71 may be provided to be equal for any one of the parameters including the number, the depth and the lead angle that satisfies the above-described relationship of magnitude between first grooves 31 and second grooves 41.

First heat exchanger 1 according to the fifth embodiment is basically similar in configuration to first heat exchanger 1 according to the first embodiment, and can thus produce similar effects to those of first heat exchanger 1 according to the first embodiment. Further, in first heat exchanger 1 according to the fifth embodiment, the heat transfer tube has a greater number of tube portions that differ in flow path resistance than in first heat exchanger 1 according to the first embodiment, and therefore, the flow path resistance can be more precisely or more roughly set.

In the refrigeration cycle apparatuses according to the first to fifth embodiments, second heat exchanger 11 may also be similar in configuration to first heat exchanger 1. In this case, first inlet/outlet portion 5 of second heat exchanger 11 may be connected to decompression unit 103, and second inlet/outlet portion 6*a* and third inlet/outlet portion 6*b* may be connected to fourth opening P4 in four-way valve 102.

The refrigeration cycle apparatuses according to the first to fifth embodiments may include at least one first groove 31 and at least one second groove 41. When the refrigeration cycle apparatuses according to the first to fifth embodiments include one second groove 41, first groove 31 may be less than second groove 41 in at least one of the depth and the lead angle. Similarly, the refrigeration cycle apparatus according to the fifth embodiment may include at least one third groove 71. When the refrigeration cycle apparatus according to the fifth embodiment includes one third groove 71, second groove 41 may be less than third groove 71 in at least one of the depth and the lead angle.

Although the embodiments of the present invention have been described as above, the embodiments described above can be modified in various manners. In addition, the scope of the present invention is not limited to the embodiments described above. The scope of the present invention is defined by the terms of the claims, and is intended to include any modifications within the meaning and scope equivalent to the terms of the claims.

The invention claimed is:

1. A heat exchanger comprising a heat transfer tube and a fin, the heat transfer tube including a first tube portion, and a plurality of second tube portions connected in parallel with each other with respect to the first tube portion, the first tube portion and the second tube portion being connected with the fin, the first tube portion having a first inner circumferential surface, and at least one first groove recessed relative to the first inner circumferential surface and arranged side by side in a circumferential direction of the heat transfer tube, the plurality of second tube portions each having a second inner circumferential surface, and at least one second groove recessed relative to the second inner circumferential surface and arranged side by side in the circumferential direction, and the at least one first groove being less than the at least one second groove in at least one of a number of grooves, a depth of each groove, and a lead angle of each groove, wherein the heat transfer tube further includes a plurality of third tube portions connected in parallel with each of the plurality of second tube portions, the plurality of third tube portions each have a third inner circumferential surface, and at least one third groove recessed relative to the third inner circumferential surface and arranged side by side in the circumferential direction, and when the at least one second groove and the at least one third groove are compared to each other in at least one of a number of grooves, a depth of each groove, and a lead angle of each groove, the at least one second groove is less than the at least one third groove in the at least one of the number of grooves, the depth of each groove, and the lead angle of each groove.

2. The heat exchanger according to claim 1, wherein the first tube portion has an outer diameter equal to an outer diameter of each of the second tube portions.

3. A refrigeration cycle apparatus comprising a compressor, a flow path switching unit, a decompression unit, a first heat exchanger, and a second heat exchanger, the flow path switching unit being provided to switch between a first state in which refrigerant flows successively through the compressor, the first heat exchanger, the decompression unit, and the second heat exchanger, and a second state in which the refrigerant flows successively through the compressor, the second heat exchanger, the decompression unit, and the first heat exchanger, and the first heat exchanger being provided as the heat exchanger according to claim 1, and being disposed such that the first tube portion is located downstream of the second tube portions in a direction in which the refrigerant flows in the first state, and the first tube portion is located upstream of the second tube portions in the direction in which the refrigerant flows in the second state.

4. The heat exchanger according to claim 1, wherein the first tube portion has an outer diameter equal to an outer diameter of each of the second tube portions.

5. A refrigeration cycle apparatus comprising a compressor, a flow path switching unit, a decompression unit, a first heat exchanger, and a second heat exchanger, the flow path switching unit being provided to switch between a first state in which refrigerant flows successively through the compressor, the first heat exchanger, the decompression unit, and the second heat exchanger, and a second state in which the refrigerant flows successively through the compressor, the second heat exchanger, the decompression unit, and the first heat exchanger, and the first heat exchanger being provided as the heat exchanger according to claim 1, and being disposed such that the first tube portion is located downstream of the second tube portions in a direction in which the refrigerant flows in the first state, and the first tube portion is located upstream of the second tube portions in the direction in which the refrigerant flows in the second state.

6. A refrigeration cycle apparatus comprising a compressor, a flow path switching unit, a decompression unit, a first heat exchanger, and a second heat exchanger, the flow path switching unit being provided to switch between a first state in which refrigerant flows successively through the compressor, the first heat exchanger, the decompression unit, and the second heat exchanger, and a second state in which the refrigerant flows successively through the compressor, the second heat exchanger, the decompression unit, and the first heat exchanger, and the first heat exchanger being provided as the heat exchanger according to claim 3, and being disposed such that the first tube portion is located downstream of the second tube portions in a direction in which the refrigerant flows in the first state, and the first tube portion is located upstream of the second tube portions in the direction in which the refrigerant flows in the second state.

7. A refrigeration cycle apparatus comprising a compressor, a flow path switching unit, a decompression unit, a first heat exchanger, and a second heat exchanger, the flow path switching unit being provided to switch between a first state in which refrigerant flows successively through the compressor, the first heat exchanger, the decompression unit, and the second heat exchanger, and a second state in which the refrigerant flows successively through the compressor, the second heat exchanger, the decompression unit, and the first heat exchanger, and the first heat exchanger being provided as the heat exchanger according to claim 5, and being disposed such that the first tube portion is located downstream of the second tube portions in a direction in which the refrigerant flows in the first state, and the first tube portion is located upstream of the second tube portions in the direction in which the refrigerant flows in the second state.

8. A refrigeration cycle apparatus comprising a compressor, a flow path switching valve, a decompression valve, a first heat exchanger, and a second heat exchanger, the flow path switching valve being provided to switch between a first state in which refrigerant flows successively through the compressor, the first heat exchanger, the decompression valve, and the second heat exchanger, and a second state in which the refrigerant flows successively through the compressor, the second heat exchanger, the decompression valve, and the first heat exchanger, and the first heat exchanger being provided as the heat exchanger according to claim 1, and being disposed such that the first tube portion is located downstream of the second tube portions in a direction in which the refrigerant flows in the first state, and the first tube portion is located upstream of the second tube portions in the direction in which the refrigerant flows in the second state.

9. A refrigeration cycle apparatus comprising a compressor, a flow path switching valve, a decompression valve, a first heat exchanger, and a second heat exchanger, the flow path switching valve being provided to switch between a first state in which refrigerant flows successively through the compressor, the first heat exchanger, the decompression valve, and the second heat exchanger, and a second state in which the refrigerant flows successively through the compressor, the second heat exchanger, the decompression valve, and the first heat exchanger, and the first heat exchanger being provided as the heat exchanger according to claim 1, and being disposed such that the first tube portion is located downstream of the second tube portions in a direction in which the refrigerant flows in the first state, and the first tube portion is located upstream of the second tube portions in the direction in which the refrigerant flows in the second state.

10. A refrigeration cycle apparatus comprising a compressor, a flow path switching valve, a decompression valve, a first heat exchanger, and a second heat exchanger, the flow path switching valve being provided to switch between a first state in which refrigerant flows successively through the compressor, the first heat exchanger, the decompression valve, and the second heat exchanger, and a second state in which the refrigerant flows successively through the compressor, the second heat exchanger, the decompression valve, and the first heat exchanger, and the first heat exchanger being provided as the heat exchanger according to claim 3, and being disposed such that the first tube portion is located downstream of the second tube portions in a direction in which the refrigerant flows in the first state, and the first tube portion is located upstream of the second tube portions in the direction in which the refrigerant flows in the second state.

11. A refrigeration cycle apparatus comprising a compressor, a flow path switching valve, a decompression valve, a first heat exchanger, and a second heat exchanger, the flow path switching valve being provided to switch between a first state in which refrigerant flows successively through the compressor, the first heat exchanger, the decompression valve, and the second heat exchanger, and a second state in which the refrigerant flows successively through the compressor, the second heat exchanger, the decompression valve, and the first heat exchanger, and the first heat exchanger being provided as the heat exchanger according to claim 5, and being disposed such that the first tube portion is located downstream of the second tube portions in a direction in which the refrigerant flows in the first state, and the first tube portion is located upstream of the second tube portions in the direction in which the refrigerant flows in the second state.

* * * * *